US010050340B2

(12) United States Patent
Merk

(10) Patent No.: US 10,050,340 B2
(45) Date of Patent: Aug. 14, 2018

(54) RADOME

(71) Applicant: Lisa Draexlmaier GmbH, Vilsbiburg (DE)

(72) Inventor: Thomas Merk, Stuttgart (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/418,042

(22) Filed: Jan. 27, 2017

(65) Prior Publication Data

US 2017/0222310 A1 Aug. 3, 2017

(30) Foreign Application Priority Data

Jan. 29, 2016 (DE) ..... 10 2016 101 583

(51) Int. Cl.
*H01Q 1/42* (2006.01)
*H01Q 1/28* (2006.01)
*H01Q 21/06* (2006.01)

(52) U.S. Cl.
CPC ..... *H01Q 1/42* (2013.01); *H01Q 1/288* (2013.01); *H01Q 21/064* (2013.01)

(58) Field of Classification Search
CPC ..... H01Q 21/0006–21/296; H01Q 13/02–13/065; H01Q 1/42; H01Q 1/421; H01Q 1/422
See application file for complete search history.

(56) References Cited

U.S. PATENT DOCUMENTS 5,140,338 A * 8/1992 Schmier ..... H01Q 1/42 343/700 MS
5,453,755 A * 9/1995 Nakano ..... H01Q 11/08 343/872

(Continued)

FOREIGN PATENT DOCUMENTS

CA 2 571 284 6/2008
CN 102414922 A 4/2012

(Continued)

OTHER PUBLICATIONS

Office Action in German Application No. DE 10 2016 101 583.0, dated Sep. 12, 2016.

(Continued)

*Primary Examiner* — Tho G Phan
*Assistant Examiner* — Patrick Holecek
(74) *Attorney, Agent, or Firm* — Finnegan, Henderson, Farabow, Garrett & Dunner LLP

(57) ABSTRACT

Embodiments of the present disclosure provide a cover for an antenna for electromagnetic radiation of a specific wavelength. The antenna includes an array of radiating elements, such as a plurality of horn antennas. The cover comprises a layer of cellular embossments, an upper side, and a lower side. The distance between the upper side and the lower side is approximately ¼ of the wavelength. The upper side of the layer comprises the area within an upper side of the embossments, the lower side of the layer comprises the area surrounding the embossments, and the lower side of the layer is arranged in a spaced relationship from the antenna in a radiating direction of the antenna. The antenna is mounted on a portable satellite terminal operating in the X band.

20 Claims, 4 Drawing Sheets

(56) References Cited

U.S. PATENT DOCUMENTS

| | | | | |
|---|---|---|---|---|
| 5,539,421 | A * | 7/1996 | Hong | H01Q 21/0031 343/771 |
| 6,437,757 | B1 * | 8/2002 | Butler | H01Q 1/42 343/872 |
| 7,889,137 | B2 * | 2/2011 | Wu | H01Q 1/38 343/700 MS |
| 8,274,445 | B2 * | 9/2012 | Collinson | H01Q 1/42 343/826 |
| 8,477,075 | B2 | 7/2013 | Seifried et al. | |
| 9,178,275 | B2 * | 11/2015 | Schultheiss | G01F 23/284 |
| 9,716,321 | B2 | 7/2017 | Oppenlaender et al. | |
| 2010/0309089 | A1 | 12/2010 | Collinson et al. | |
| 2015/0004423 | A1 | 1/2015 | Cheon et al. | |
| 2015/0084814 | A1 * | 3/2015 | Rojanski | H01Q 1/42 342/368 |
| 2015/0188236 | A1 | 7/2015 | Oppenlaender et al. | |

FOREIGN PATENT DOCUMENTS

| | | | |
|---|---|---|---|
| CN | 102437424 | A | 5/2012 |
| CN | 104428948 | A | 3/2015 |
| DE | 199 02 511 | A1 | 8/2000 |
| DE | 10 2010 019 081 | A1 | 11/2010 |
| WO | WO 2010/144455 | A1 | 12/2010 |
| WO | WO 2014 005691 | A1 | 1/2014 |

OTHER PUBLICATIONS

Office Action in German Application No. DE 10 2016 101 583.0, dated Sep. 7, 2016.

Office Action in German Application No. DE 10 2016 101 583.0, dated Mar. 13, 2017.

Decision to Grant in German Application No. DE 10 2016 101 583.0, dated May 22, 2017.

Summons to Attend Oral Hearing in German Application No. DE 10 2016 101 583.0, dated Apr. 4, 2017.

Chinese Office Action in Appln. No. 201710060134.6 dated Mar. 9, 2018.

* cited by examiner

RADOME

CROSS REFERENCE TO RELATED APPLICATION

This application is based upon and claims the benefit of prior German Patent Application No. 10 2016 101 583.0, filed on Jan. 29, 2016, the entire contents of which are incorporated herein by reference.

TECHNICAL FIELD

The present disclosure relates to a cover for an antenna, in particular for antenna systems for mobile satellite communication.

BACKGROUND

Antennas for use under hostile environmental conditions, as is the case with antenna systems in mobile satellite communication, should be covered to prevent soiling or damage, regardless of whether they are portable or mounted on aircraft or other vehicles.

German patent document DE 10 2010 019 081 A1 shows an antenna designed as an array of horn antennas.

Depending on how the antenna is used, the range of conditions concerning which protection is required can include humidity, rain, sand, dust, chemicals, lightning, collisions with birds (in the case of airplanes) and many more. The electrical or high-frequency performance capacity of the radome (i.e. the cover or structure protecting the antenna) of the antenna is also important. This is indicated by electrical losses and suppression of cross-polarization.

The electrical losses are both reflective and dissipative in nature. Whereas the dissipative losses arise from the dielectric properties of the materials used, the reflections are defined by the quality of the high-frequency design. A skillful selection of materials, geometries and structures can minimize the reflective losses for the desired area of use and frequency range.

According to the state of the art, multi-layer sandwich structures of different composite and similar materials may be selected for a cover (i.e. a radome) for antennas.

DE 199 02 511 A1 discloses a basic design and function of a cover for antennas. A conventional sandwich-type radome has three interconnected layers: an inner liner, a radome core (having a thickness equal to ¼ of the wavelength, smallest possible dielectric constant) and an outer lining. In the case of two reflective layers spaced apart one behind the other at a distance of ¼ of the wavelength, the two resulting sub-reflections cancel each other out, since the phase difference of the two sub-waves equals 2*¼ of the wavelength, i.e. 180°. This keeps the reflections of the wave at the cover at a low level. Manufacturing these radomes requires a corresponding knowledge of adhesion, laminating and composite techniques, and also a well-balanced selection of the different materials.

In some applications, such as in airplanes, the radome is curved to improve the aerodynamic properties of the antenna mounted on the fuselage. For example, WO 2014/005691 A1 discloses that a radome (i.e. the cover of an antenna) can display polarization isotropy due to a curvature, which can result in marked changes in the axial ratio of circularly polarized signals passing through the radome. DE 10 2010 019 081 A1 discloses a radome that has been aerodynamically optimized.

United States Patent Application No. 2010/0309089 A1 discloses an antenna with several dipole elements. The dipole elements are provided with a cover that has a honeycomb structure, thereby forming partitions between the dipole elements and an individual radome for each dipole element.

SUMMARY

Embodiments of the present disclosure provide a simplified structure for an antenna cover, relative to a sandwich-type cover design.

According to embodiments of the present disclosure, a cover of an antenna for electromagnetic radiation of a specific wavelength comprises a layer with uniformly arranged cellular embossments. When viewed from an upper side or lower side of the layer, the layer within an embossment is spaced apart from the layer outside of the embossment by a distance that corresponds to approximately ¼ of the wavelength of the antenna signals. The cover and hence also the underside of the layer are later mounted in the direction of radiation of the antenna and in spaced relationship to the antenna, thereby forming a radome for the antenna.

According to embodiments of the present disclosure, a cover of an antenna for electromagnetic radiation of a wavelength is provided. The cover comprises a layer comprising a plurality of cellular embossments, an upper side, and a lower side, with a distance between the upper side and the lower side being approximately ¼ of the wavelength, wherein the upper side of the layer comprises an area within an upper side of the embossments, the lower side of the layer comprises an area surrounding the embossments, and the lower side of the layer is arranged in a spaced relationship from the antenna in a radiating direction of the antenna.

According to embodiments of the present disclosure, an antenna for satellite communication is provided. The antenna comprises an array of radiating elements and a cover configured sealing the array. The cover comprises a plurality of cellular embossments, an upper side, and a lower side, a distance between the upper side and the lower side being approximately ¼ of the wavelength of the antenna, wherein the upper side of the cover comprises the area within an upper side of the embossments, the lower side of the cover comprises the area surrounding the embossments. The cover is mounted on the antenna such that the lower side of the cover is spaced in relation to the array of radiating elements.

According to embodiments of the present disclosure, a cover of an antenna for electromagnetic radiation of a wavelength is provided. The cover comprises a layer defining a continuous surface, the layer comprising a plurality of cellular embossments, an upper side, and a lower side arranged parallel to the upper side, a depth of the embossments corresponding to a distance between the upper side and the lower side, and lateral supports configured to separate the lower side of the layer from the antenna, wherein an upper side of the embossments defines the upper side of the layer, the area surrounding the embossments defines the lower side of the layer, and the distance between the upper side and lower side is substantially equal to ¼ of the wavelength.

According to embodiments of the present disclosure, in the radiating direction of the antenna, i.e. orthogonally to the aperture of the antenna, the layer has cellular embossments with different contours. Depending on the shape of the embossments, different views of the embossments generally appear from the two sides of the layer. However, it is also contemplated that identical views of the cover are generated if the embossments are precisely square and diagonally arranged or if they are tapered.

According to embodiments of the present disclosure, the embossments may form a type of pseudo-three-layer structure using only one layer of material. The pseudo-three-layer structure includes a pseudo-inner layer and a pseudo-outer layer. Due to the embossments, the pseudo-inner layer and pseudo-outer layer may each have a lower effective dielectric constant than a solid material. This may improve the degree and achievable bandwidth of the reflection suppression. The depth of the embossments or the spacing of the pseudo-inner/outer layers (for example, as in the conventional sandwich radome) may be set at approximately ¼ of the wavelength to minimize reflections. The cover can be operated bidirectionally. For example, the lower side or the upper side of the cover can face the antenna aperture or similarly slight reflections can be achieved for transmitting and receiving operations.

According to embodiments of the present disclosure, the cover may be spaced slightly apart from the surface of the antenna. For example, the lower side of the cover may arranged such that the lower side does not lie directly on the antenna, but rather is spaced so that the emitted wave of the antenna is substantially plane in the area of the cover. For example, this may be achieved by spacing the cover and the surface of the antenna by about ¼ of the antenna wavelength.

According to embodiments of the present disclosure, a polarization filter may be placed between the antenna and the cover thus constituting a polarization layer. The hollow space between the antenna and the cover may accordingly be larger to accommodate the polarization filter. For example, the distance may be at least ½ of the antenna wavelength.

According to embodiments of the present disclosure, the cover may protrude beyond the antenna in the x and y directions to avoid distortion at the edges of the antenna. For example, these distortions may become negligible with a protrusion of as little as approximately one wavelength.

According to embodiments of the present disclosure, the upper side may be separated from the lower side of the layer by less than ¼ of the wavelength. Thus, the layer may be very thin. For example, the thickness of the layer may be between 0.5 and 3 mm. The thickness of the layer is selected for a desired balance between mechanical stability (i.e. using as thick a layer as possible) and low dissipative losses or superimposed reflections on the lower and the upper sides of the layer (i.e. using as thin a layer as possible).

According to embodiments of the present disclosure, the embossments may be symmetrically shaped in the x and y directions of the upper and lower sides, and/or are mutually arranged so as to yield a symmetrical distribution of the embossments in the x and y directions of the upper and/or lower sides. Thus, the cover may also be suitable for electromagnetic radiation of circular polarization. In circular polarization, both orthogonal field components must be treated identically, as undesirable cross-polarization effects may otherwise occur. For purely linear polarizations, asymmetrical (e.g., rectangular) embossments or groups of embossments may be used.

According to embodiments of the present disclosure, the area sums of the upper sides and the area sums of the lower sides of the layer may be approximately equal. Therefore, the signal intensities reflected inside and outside the embossments are approximately equal, which optimizes the cancellation effect.

According to embodiments of the present disclosure, to keep the layer as thin as possible while maintaining a large degree of stability, at least one reinforcement around the embossment may be provided, between the upper and the lower sides, in addition to the side walls. This reinforcement connects both the upper and the lowers side between two embossments. The reinforcement may be wider at a transitional area from the reinforcement to a side wall of the embossment. This may make it easier to mill the cover through the curves and may improve the dissipation of force between the embossments. Alternative manufacturing processes for the cover may include deep-drawing, injection molding or 3D printing. The side walls between the upper and the lower sides may be slightly tapered for this purpose.

According to embodiments of the present disclosure, at least one reinforcement is arranged around the embossment. The reinforcement may connect two adjacent embossments at the upper side and the lower side of the layer. The reinforcement may also comprise a protrusion, such that the reinforcement has a width at the embossment that is greater than a distance of the protrusion from the embossment.

According to embodiments of the present disclosure, the cover may be used for an antenna system comprising an array of horn antennas. A uniform arrangement of the embossments may be used for this purpose. Embossments and horn antennas can then be oriented to one another accordingly. A reinforcement or a side wall may be arranged at a center of a horn antenna to orient the radiation pattern of the horn antenna toward its center. A reinforcement or side wall may contain a larger volume of the material of the layer. As an alternative, a point (e.g. a center point) of the layer between embossments that are adjacent in the x and y directions is oriented to the center of the horn antenna.

According to embodiments of the present disclosure, the dimensions of the embossment in the x and y directions can be selected to represent a desired compromise between electrical performance and mechanical stability. For example, larger dimensions of the embossment may provide a lower effective dielectric constant of a pseudo-core of the embossment (i.e. the hollow space within the embossment), lower reflections, and a lower weight. The structure may also be more fragile structure at some point in time.

According to embodiments of the present disclosure, a compromise between mechanical stability and high electrical performance can be reached through appropriate mechanical reinforcements. For example, the radome may use hexagonal shapes similar to those found in honeycombs or shapes similar to those found in egg cartons to achieve a high mechanical stability at a light weight.

According to embodiments of the present disclosure, a dimension of a horn antenna in the x and y directions may be equal to, a multiple of, or an even fraction of a cellular embossment to minimize reflections on the cover across the entire horn antenna array and to distribute reflections evenly.

According to embodiments of the present disclosure, the embossments may be substantially square. The embossments may also have production-related curvatures in the transitional area between the side wall and the upper and/or lower side or between the side walls, to make it easier to produce them by milling.

According to embodiments of the present disclosure, the layer can consist of synthetic materials such as polypropylene, polyethylene or polyamide, and that a material with a low dielectric constant is selected from this group of materials.

According to embodiments of the present disclosure, an antenna is mounted on a portable satellite terminal for an X band (7.25 GHz-8.40 GHz). Such an antenna may include an arrangement of more than 1000 embossments per square meter. For example, for the X band, this may include between 1000 and 1200 embossments per square meter. For a cover that is optimized to the center frequency of the X band, the width of an embossment may be approximately 3 cm. In an application of this type for satellite communication the cover may be mounted onto a radiating element array of the antenna, such as a horn antenna array, thereby forming a seal. However, the cover can also be used for other types of antenna. While the radome described here is optimized for portable, mobile applications in the X band, it can be rescaled for use in other frequency ranges.

According to embodiments of the present disclosure, a hollow space between the antenna and the cover is generally filled with air. To obtain a large degree of mechanical stability this hollow space can also be foamed out.

According to embodiments of the present disclosure, for portable satellite receivers/transmitters the side walls of the cover may be perpendicular to the antenna, since there are no particular aerodynamic requirements. In applications on aircrafts in which the cover is positioned in the airflow, the embossments of the upper side may be filled with a material that results in a smooth surface and that has a dielectric constant close to that of air.

According to embodiments of the present disclosure, the shape of the cover may be substantially plane and parallel to the antenna. For the aforementioned application on aircrafts, the cover may be bent into an aerodynamically favorable shape such as a paraboloid.

According to embodiments of the present disclosure, additional protection of the cover layer may be provided. For example, the additional protection may be via a coating on the upper side of the layer with a UV-resistant protective varnish layer with no metal particles. The dielectric constant of the varnish should be particularly low, for example smaller than that of the layer.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure. The accompanying drawings shall only be regarded to be of a schematic, exemplary nature, and not as being true to scale.

DETAILED DESCRIPTION

Figure 1:
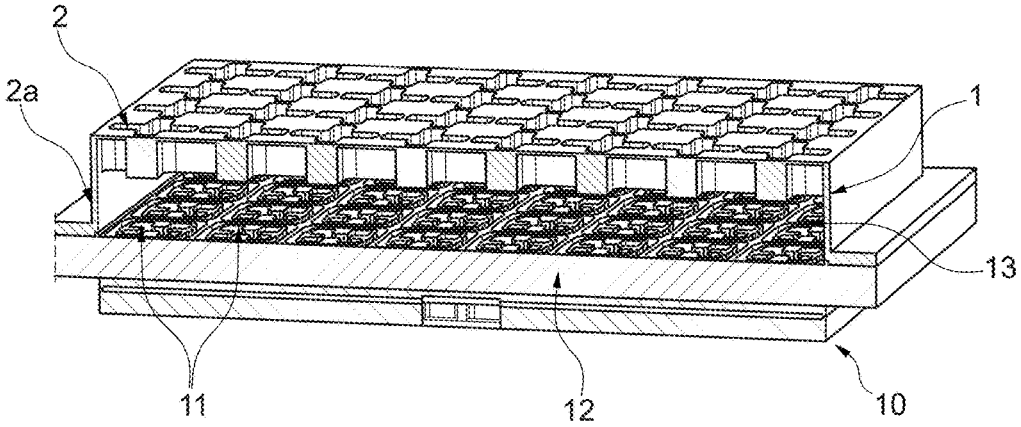
FIG. 1 is a perspective view of an antenna with a cover according to the present disclosure.

FIG. 1 shows a perspective view of an antenna 10 with the cover 1 according to an embodiment of the present disclosure. The antenna 10 includes an array 12 of radiating elements, for example, a plurality of horn antennas 11. The antenna 10 also includes a feed network connecting the individual horn antennas 11 to a transmitting and receiving unit (not shown in FIG. 1).

The cover 1 is mounted to the antenna 10 such that a space greater than or equal to ½ of the wavelength of the antenna is maintained between the cover and the antenna, and a seal is formed so that environmental influences do not effect operation of the antenna 10. The cover 1 is essentially plane and consists of a layer 2 and supports 2*a*. The layer 2 and the supports 2*a* may be made of the same material. The supports 2*a* separate the layer 2 from the antenna 10, align the layer 2 parallel to the radiating element array 12 and create a seal or enclosure. The layer 2 has a protective coating of varnish on its upper side 4 (see FIG. 4). The layer 2 may be made of Teflon, for example.

A meander-type polarization layer 13 can be introduced into the hollow space shown between the radiating element array 12 and the cover 1. The meander-type polarization layer converts linear polarized waves to circular polarized waves.

The layer 2 and the radiating element array 12 are essentially plane, but may include structures that are perpendicular to this plane. These structures may be formed by milling and are shown in FIG. 2.

Figure 2:
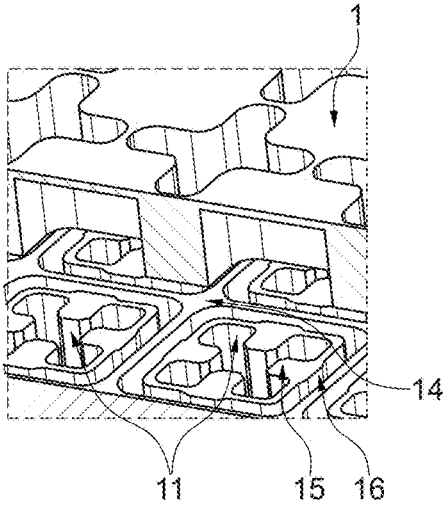
FIG. 2 is a perspective view showing details of an antenna with a cover according to the present disclosure.

In FIG. 2, the horn antennas 11 of the radiating element array 12 are embodied as ridged horn antennas with an additional corrugation 16. However, other forms of horn antenna may also be used.

A ridged horn antenna is surrounded at the aperture end (i.e. towards the opening of the horn antenna 11 shown in FIG. 2) by a single radiating element edge 14 that is separated from the ridged horn antenna by the corrugation 16. The single radiating element edge 14 here is connected to a single radiating element in spaced relationship to the aperture surface.

Ridges 15 (i.e. constrictions) of the ridged horn antennas lower the cutoff frequency, so that the installation size for the frequency ranges of interest can be reduced. The corrugation 16 improves matching and reduces undesirable cross-polarization. As a result of this arrangement, a wave from the ridged horn antenna and a wave from the corrugation 16 are superimposed. The corrugation 16 may be dimensioned such that a wave entering the corrugation 16 and reflected at an end of the corrugation 16 is structurally superimposed by a wave emerging from the ridged horn antenna.

The single radiating element edge 14 may have a rectangular shape. The rectangular shape may include rounded corners produced via the manufacturing process. The ridged horn antenna is arranged in the center of the rectangular-shaped single radiating element edge 14. Thus, several single radiating elements of this kind can be combined to form a horn antenna array 12 without loss of space. A square contour of the single radiating element edge 14 may simplify the combined horn antenna array in both directions. With a centered arrangement of the ridged horn antenna, the radiation pattern is oriented to the center of the single radiating element. Considering that a slight inclination of the radiation pattern to the side of the electric field incoupling may be compensated for in the case of an electric field incoupling, the arrangement of the ridged horn antenna may also be slightly offset from the center.

The corrugation 16 has substantially perpendicular walls in relation to the aperture area. The corrugation 16 opens directly to the aperture area and avoids an inclination, which would otherwise result in increased space requirements parallel to the aperture area.

The number of ridges required is dependent on the number of polarizations that are supported. The ridged horn antenna shown in FIG. 2 has four ridges arranged crosswise, each of which is oriented to the center of the ridged horn antenna. This arrangement is generally symmetrical, so that an angular distance between two ridges is 180° or 90°. Additional details on the ridged horn antenna can be found in DE 10 2014 112 825 A1, the contents of which are incorporated by reference.

Figure 3:
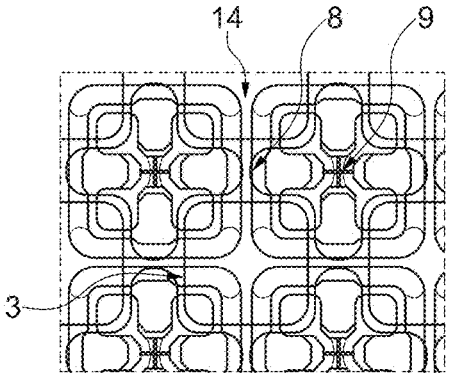
FIG. 3 is a plan view showing structural outlines of a cover and a horn antenna array.

A possible alignment of the cover 1 over the radiating element array 12 is shown in FIG. 3. The contours of embossments 3 of the cover 1 are explained below with reference to a center 9 of the horn antenna 11. As shown in FIG. 3, the embossments 3 are not oriented to the center 9 of the horn antenna 11. Rather their complement, in the form of a rounded cross, between the embossments 3 is oriented to the center 9 of the horn antenna 11. Reinforcements 8 (described below) lie over the single radiating element edges 14. This arrangement enables the decoupling of the radiation pattern of adjacent horn antennas 11 while providing a high material density of the layer 2 at the center 9.

Alternatively, the reinforcement 8 between embossments 3 can be oriented to the center 9 of the horn antenna. Here the enhanced material density of the cover may cause the radiation pattern of a horn antenna to be oriented to the center 9.

Figure 4:
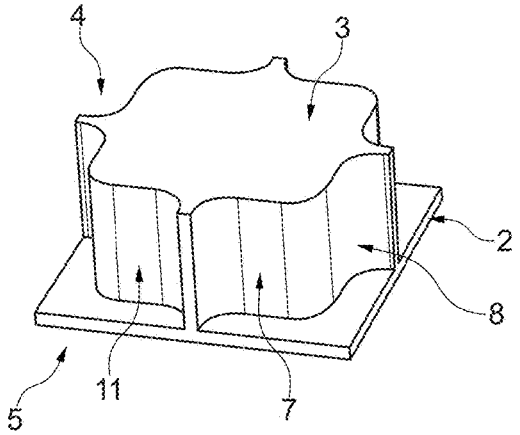
FIGS. 4-6 are perspective views showing various aspects of a cellular embossment of a cover.
Figure 5:
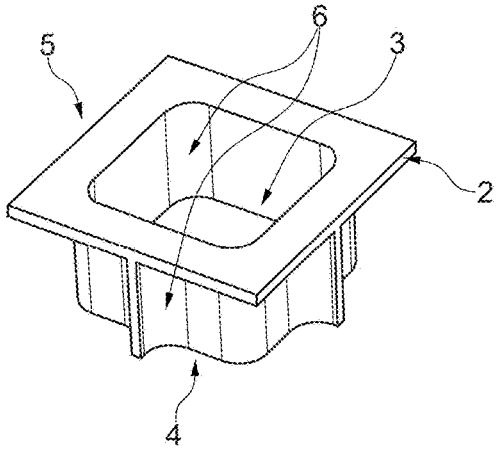
Figure 6:
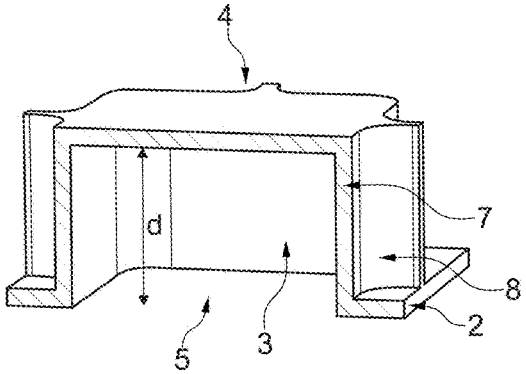

The cellular embossments 3 of the layer 2 are illustrated in FIGS. 4 to 6. The layer 2 has an upper side 4 and a lower side 5. The layer 2 is relatively thin, for example having a thickness of 1.2 mm, in comparison to a depth d of layer 2, which is the distance between the upper side 4 and the lower side 5 of the layer 2 through the embossment 3 (as shown in FIG. 6).

Viewed from the upper side 4 (see FIG. 4), reinforcements 8 can be seen arranged between sidewalls 7 of the embossment 3 toward adjacent embossments (not shown in FIG. 4). The sidewalls 7 are perpendicular to the upper side 4 and the lower side 5 of the layer 2. The reinforcement 8 is wider in the transitional area from the reinforcement 8 to a side wall 7 of the embossment 3. Curvatures 6 are provided at the transition from the reinforcement 8 to the side wall 7, and in the embossment 3 between the side walls 7, as shown in FIG. 5.

In the embossment 3 shown in FIG. 5, the basic square shape of the embossment 3 can be more clearly seen. The upper side 4 (see FIG. 4) and the lower side 5 (see FIG. 5) of the layer 2 are both plane but separated by the depth (i.e. the distance d shown in FIG. 6) of the embossment 3 and the thickness of the layer 2.

FIG. 6 shows that the thickness of the layer 2 may be smaller than the distance d from the lower side 5 of the layer 2 inside the embossment 3 to the upper side 4 of the embossment 3. The thickness of the layer 2 may be, for example, 1.2 mm. The distance d is determined by the wavelength of the electromagnetic radiation of the antenna. For a frequency band, for example 7.25 GHz-8.4 GHz in the X band, the center frequency f is selected, here f=7.825 GHz, to determine the distance d. The distance d is yielded from ¼ of the wavelength λ, thus in this case d=c/4*f approx. 1 cm, wherein c is the speed of light.

Figure 7:
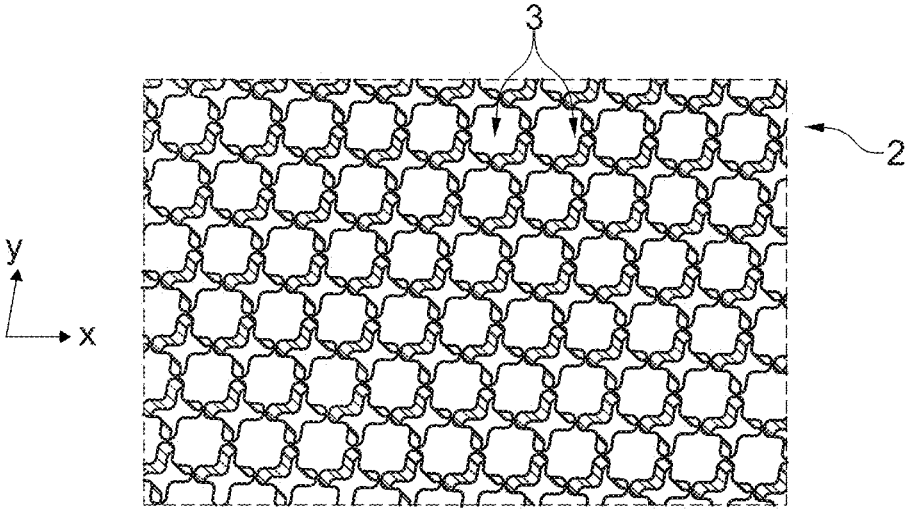
FIGS. 7-8 are perspective views showing details of a cover with multiple embossments.
Figure 8:
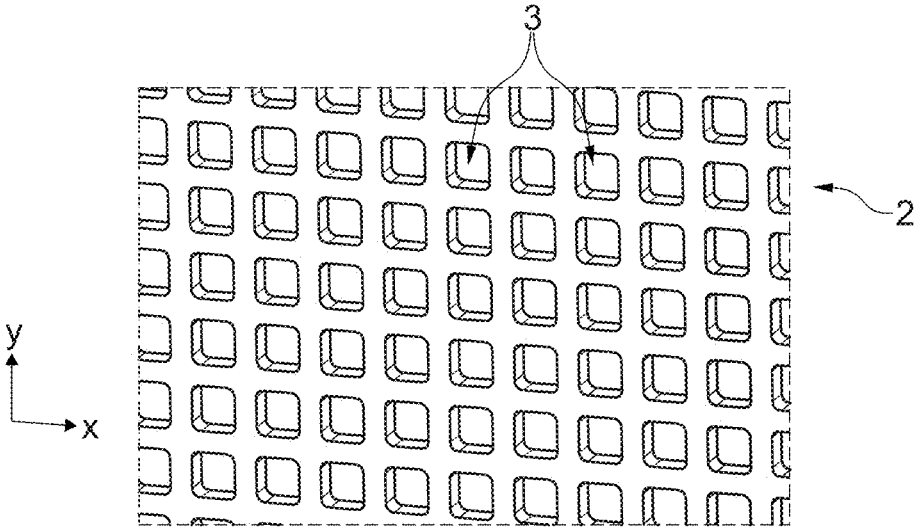

FIGS. 7 and 8 show remote views of the layer 2 with a plurality of embossments 3, viewed from the upper side 4 (FIG. 7) and the lower side 5 (FIG. 8). The embossments 3 are symmetrical in both directions of extension x and y of the plane layer 2. The arrangement of the embossments 3 provides a distance between the cellular embossments that remains constant across the surface in both directions x and y. The number of embossments 3 per square meter may lie between 1000 and 1200, if as in the present case one embossment 3 per horn antenna 11 is selected. As an alternative, one embossment 3 can also cover 4, 9, 16, etc. horn antennas 11 or conversely, 4, 9, 16, etc. embossments 3 per horn antenna 11 can also be provided.

Therefore, despite having only one layer 2, the antenna 10 is given a virtual multi-layer structure comprised of two portions spaced apart by ¼ of the wavelength λ. The embossments 3 also include high air content (inside the embossments 3), providing an effective dielectric constant that is lower than that of the material of the layer 2, signifying low reflections across the bandwidth of the X band (as shown in FIG. 9, for example).

In some embodiments of the present disclosure, the embossments 3 include dimensions such that the sum of the areas of the upper side 4 of layer 2 (i.e. the upper sides as shown in FIG. 7) is equal to the sum of the areas of the lower side 5 of the layer 2 (i.e. the lower sides as shown in FIG. 8). Thus, both reflective areas have roughly the same proportion of beams reflected at the layer 2 and can cancel each other out.

Figure 9:
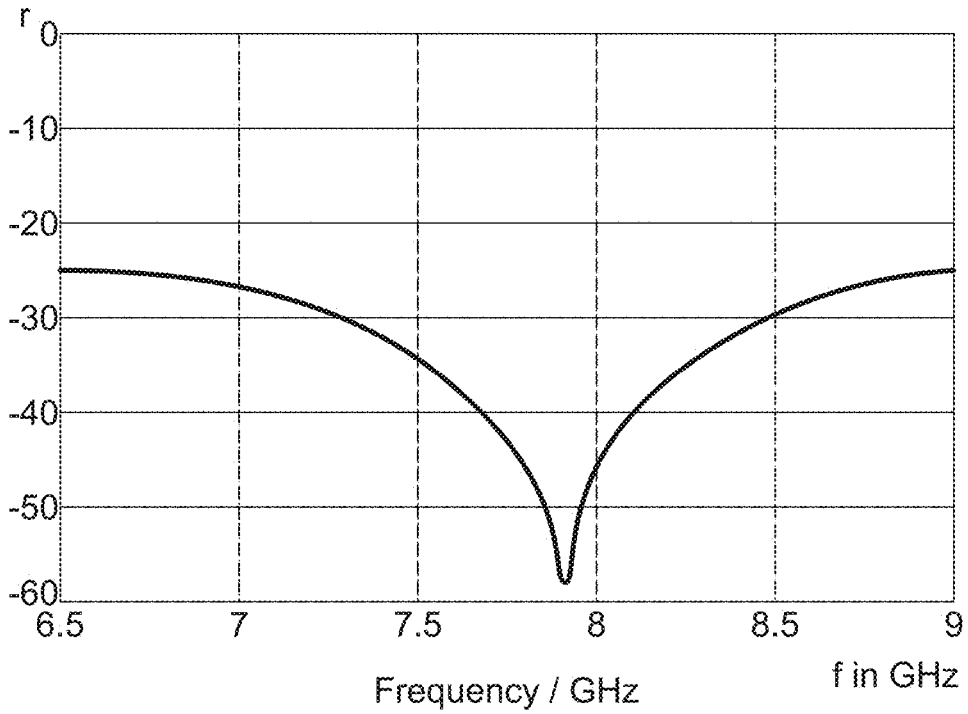
FIG. 9 is a graph showing the reflective behavior of a cover in the X band.

FIG. 9 shows a reflectance factor r for the cover of the present disclosure. Reflections amount to less than −30 dB in the range of 7.25 GHz to 8.4 GHz, such that that less than 0.1% of the antenna power is reflected. The reflective losses in this case are essentially zero and only the material-dependent internal dissipative losses remain.

Embodiments of the present disclosure describe an efficient cover (i.e. radome) of an antenna for the X band that can be used for portable antennas in mobile satellite communication. For example, the antenna (10) may be mounted on a portable satellite terminal (20) for an X band. However, this cover can also be rescaled for other frequency bands in accordance with the designated design criteria.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS cover 1
layer 2
support 2*a*
embossments 3
upper side 4
lower side 5
side walls 7
curvature 6
reinforcement 8
center of a horn antenna 9
antenna 10
horn antenna 11
radiating element array 12
single radiating element edge 14
constriction 15
corrugation 16 satellite terminal 20
distance d
frequency f
reflectance factor r
wavelength λ

What is claimed is:

1. A cover of an antenna for electromagnetic radiation of a wavelength, the cover comprising:

a layer comprising a plurality of cellular embossments, an upper side, and a lower side, a distance between the upper side and the lower side being approximately ¼ of the wavelength;

wherein:

the upper side of the layer comprises the area within an upper side of the embossments;

the lower side of the layer comprises the area surrounding the embossments; and the lower side of the layer is arranged in a spaced relationship from the antenna in a radiating direction of the antenna.

2. The cover according to claim 1, wherein the distance between the upper side of the layer and the lower side of the layer is less than ¼ of the wavelength and a thickness of the layer is between 0.5 and 3 mm.

3. The cover according to claim 1, wherein the layer extends in an x and y direction, and the embossments are symmetrically shaped in the x and y directions of the upper side of the layer.

4. The cover according to claim 1, wherein the layer extends in an x and y direction, and the embossments are arranged relative to one another so as to yield a symmetrical distribution of the embossments in an x and y direction of the upper side of the layer.

5. The cover according to claim 1, wherein an area sum of the area within the upper sides of the embossments is approximately equal to an area sum of the area surrounding the embossments.

6. The cover according to claim 1, wherein the embossments comprise:

side walls between the upper side and the lower side of the layer; and at least one reinforcement arranged around the embossment, the reinforcement connecting two adjacent embossments at the upper side and the lower side of the layer.

7. The cover according to claim 6, wherein the reinforcement comprises a protrusion, the protrusion having a width at the embossment that is greater than a width at a distance from the embossment.

8. The cover according to claim 1, wherein the antenna is a horn antenna array comprising a plurality of horn antennas.

9. The cover according to claim 6, wherein:

the antenna is a horn antenna array comprising a plurality of horn antennas; and a reinforcement of an embossment connects to a reinforcement of an adjacent embossment at a connection point, the connection point being oriented to a center of a horn antenna.

10. The cover according to claim 8, wherein the layer extends in an x and y direction, and a dimension of the horn antenna in the x and y directions is equal to, a multiple of, or an even fraction of a dimension of an embossment.

11. The cover according to claim 1, wherein the embossments are substantially square.

12. The cover according to claim 6, wherein the embossments comprise curvatures in the transition between the reinforcement to the side wall or between the side walls within an embossment.

13. The cover according to claim 1, wherein the layer is selected from the group consisting of polypropylene, polyethylene and polyamide.

14. The cover according to claim 1, wherein the layer comprises at least 1000 embossments per square meter.

15. The cover according to claim 1, wherein the antenna operates in the X band, and the layer comprises between 1000 and 1200 embossments per square meter.

16. The cover according to claim 1, wherein the layer is substantially plane and comprises a protective coating.

17. An antenna for satellite communication, comprising:

an array of radiating elements for electromagnetic radiation of a wavelength; and a cover configured to seal the array, the cover comprising:

a plurality of cellular embossments;

an upper side; and a lower side separated from the upper side in a radiating direction of the antenna by a distance of approximately ¼ of the wavelength.

18. The antenna according to claim 17, wherein the antenna is mounted on a portable satellite terminal operating in the X band.

19. A cover of an antenna for electromagnetic radiation of a wavelength, the cover comprising:

a cover layer defining a continuous surface, the layer comprising a plurality of cellular embossments, an upper side, and a lower side arranged parallel to the upper side, a depth of the embossments corresponding to a distance between the upper side and the lower side; and lateral supports configured to separate the lower side of the layer from the antenna;

wherein:

an upper side of the embossments defines the upper side of the layer;

the area surrounding the embossments defines the lower side of the layer; and the distance between the upper side and lower side is substantially equal to ¼ of the wavelength.

20. The cover according to claim 19, wherein the upper side of the embossments is substantially square, and the embossments comprise:

side walls between the upper side of the layer and the lower side of the layer; and at least one reinforcement arranged around the embossment connecting the upper side and the lower side of the layer between two adjacent embossments.

* * * * *